United States Patent [19]

Kirchner et al.

[11] Patent Number: 4,619,414

[45] Date of Patent: Oct. 28, 1986

[54] MULTI-DISK REFINER

[75] Inventors: Edward C. Kirchner, Pittsfield; Ronald J. DeFoe, Becket, both of Mass.

[73] Assignee: Beloit Corporation, Beloit, Wis.

[21] Appl. No.: 697,049

[22] Filed: Jan. 31, 1985

[51] Int. Cl.[4] ..... B02C 7/14

[52] U.S. Cl. ..... 241/261.3; 241/285 R; 241/297

[58] Field of Search ..... 241/261.2, 261.3, DIG. 30, 241/296, 297, 298, 259.3, 259.1, 290, 146

[56] References Cited

U.S. PATENT DOCUMENTS

| | | | |
|---|---|---|---|
| 1,072,033 | 9/1913 | Reynolds | 241/259.3 |
| 1,995,549 | 3/1935 | Myers | 241/296 X |
| 2,567,448 | 9/1951 | Rickerich, Jr. et al. | 241/296 |

*Primary Examiner*—Mark Rosenbaum

*Attorney, Agent, or Firm*—Hill, Van Santen, Steadman & Simpson

[57] ABSTRACT

An apparatus for refining fibrous materials such as stock suspensions for papermaking which includes a housing, an inlet and outlet in said housing for receiving and discharging the treated materials, a shaft rotatable in said housing, a plurality of rotating refiner disks spaced along the shaft and an additional plurality of refiner disks interspersed with the rotor disks and providing therewith refining gaps through which the stock suspension passes. The other refiner disks can be either stationary or counter-rotating with respect to the rotor disks. The two sets of refiner disks are supported by means of axially flexible membranes. The present invention provides refiner disks which have undercut portions in the surfaces adjacent to the flexible annular membranes to increase the axial flexibility of the membranes.

8 Claims, 6 Drawing Figures

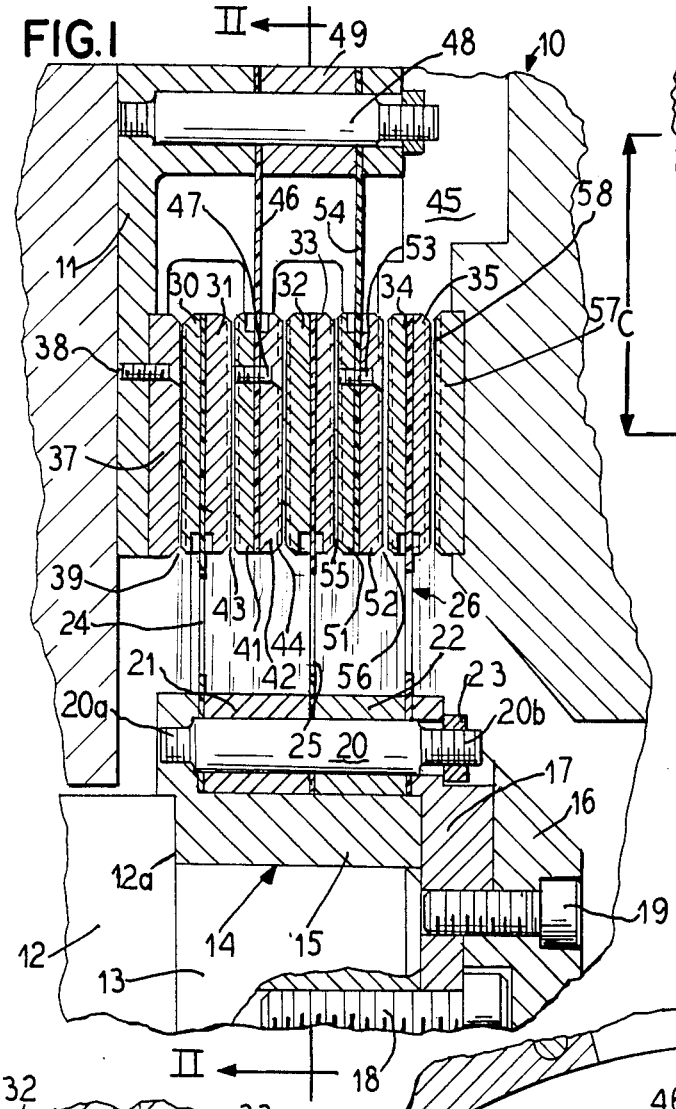
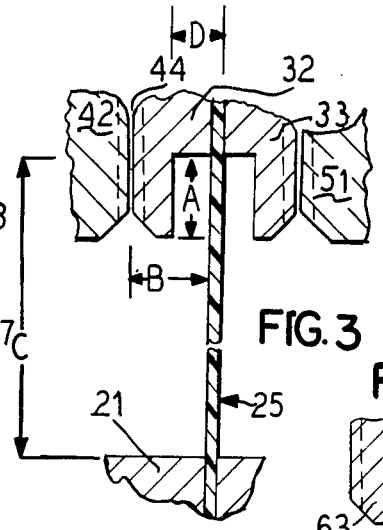
FIG. 3
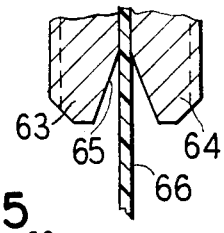
FIG. 6
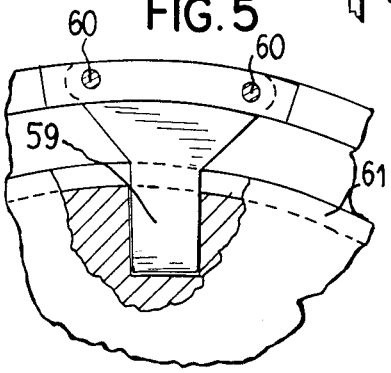
FIG. 5
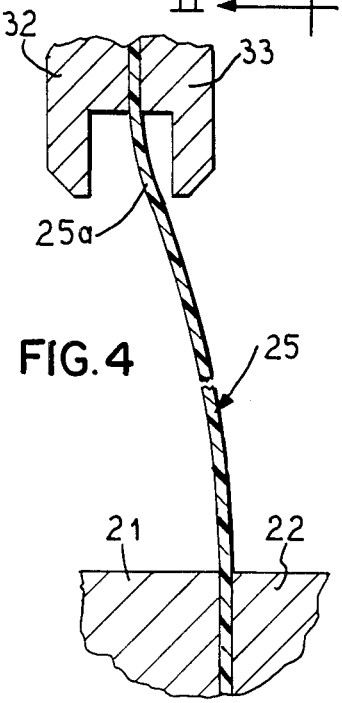
FIG. 4
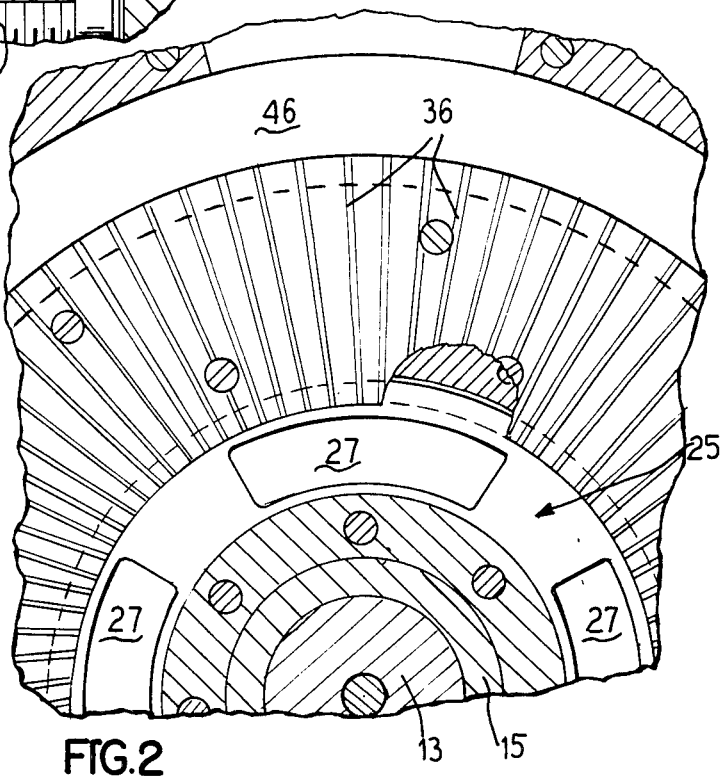
FIG. 2

MULTI-DISK REFINER

BACKGROUND OF THE INVENTION

1. Field of the Invention

The present invention is in the field of multiple disk refiner assemblies utilizing axially flexible membranes for supporting the confronting refining disks and being provided with undercut portions which significantly improve the flexibility of axial movement capability in the refiner disks.

2. Description of the Prior Art

After paper stock has been treated in beaters, digesters or other pulping machines, it is usually refined by passing it between grinding or refining surfaces which break up the fibrous materials and serve to create further separation and physical modification of the fibers.

A typical pulp refiner is disclosed in Thomas U.S. Pat. No. 3,371,873. The type of refiner disclosed therein includes a rotating disk which has annular refining surfaces on one or both sides. The disk refining surfaces are in confronting relation with non-rotating annular grinding surfaces and provide a refining zone therebetween in which the pulp is worked. The rotating disk and the refining surfaces are made of inflexible material such as cast iron or a hard stainless steel. The non-rotating grinding surfaces are made of similar materials and are rigidly mounted so as to resist the torque created by the rapidly rotating disk and the pressure on the pulp material passing through the refining zone gap. Axial adjustment of the refining zone gaps is effected by axial shifting of the shaft on which the disk is mounted.

Rigid disk refiners of this type must be manufactured and assembled to close tolerances in order to set the refining zone gap width correctly. Because the loads supplied to the rigid disk are large during the refining process, a large and extremely rugged design is necessary so that the refining surface relationships do not change under load. This results in the rigid disk refiners being very costly due to the necessarily close tolerance machining, the need for large quantities of high-strength disk material, the bulky overall structure, the restrictive machine capacity, and the excessive assembly time requirements.

Substantial improvements in pulp refiners have recently been accomplished with the development of a multiple disk refiner which is usually designed to operate at a low intensity. In copending Matthew and Kirchner U.S. Pat. No. 4,531,681 entitled "Flexible Disk Refiner and Method" issued July 30, 1985 and assigned to the same assignee as the present application, there is disclosed a refining apparatus which includes a plurality of radially extending, relatively rotatable and axially confronting refining surfaces between which the suspension passes while being refined during relative rotation of the surfaces. Means are provided for effecting flow of the material radially between and across the surfaces. The supporting means employed in that application consists of resiliently flexible supporting means which permit adjustment of the relatively rotating refining surfaces axially relative to each other depending on the operating pressure so that optimum material working results from the refining surfaces.

In the specific embodiment disclosed in the aforementioned application, there is provided a pulp refiner with ring-shaped refining surface plates of limited radial width which are mounted on interleaved margins of axially resilient flexible or deflectable disk elements or membranes. Disk margins spaced from the interleaved margins on one set of the disk elements are secured to a rotor while the margins on another set of disks are secured nonrotatably or counter-rotatably. The refining surface plates are made of a suitably hard, substantially rigid material. The disk elements on the other hand are made of axially resilient flexible material which strongly resists deformation in the circumferential direction. Because of the manner in which the axially flexible disk elements are supported, there is an automatic axial self-alignment of the refining surfaces during the pulp-refining process for attaining optimum refining action by the relatively rotating refining surfaces.

The multiple disk refiner represents a substantial improvement in the art of refining. It has been shown that with the use of a low intensity, multiple disk refiner pulp characteristics can be improved considerably over those obtained by using conventional refining techniques. Originally, such refiners were built using flexible diaphragms to restrain the refining disks and to provide the torsional rigidity and strength required to transmit rotational forces into the refining surfaces. The resiliency of the diaphragms permits sufficient axial motion of the refiner disks such as required as each surface moves into close proximity to its adjacent neighbors as the refiner is loaded to its operational position.

In the usual multi-disk refiner, a fiberglass composite membrane is used to achieve axial flexibility, the refiner disks being attached to the membranes. To maintain a minimal force gradient and thus uniform refining properties across the disk pairs, a low axial spring constant characteristic of the disk is required. The axial flexibility is a function of the properties of the material and the geometry.

SUMMARY OF THE INVENTION

The present invention seeks to improve the axial flexibility by undercutting the refiner disks a controlled amount sufficient to increase the axial flexibility of the supporting membrane but not so great as to significantly reduce the refining characteristics. In the preferred embodiment of the invention, the undercut portions have a radial extent of at least 10% of the radial annular dimensions of the refiner disks and the axial depth of the undercut portions is between about 10% and 50% of the maximum axial dimension of the disks.

The undercutting of the disks is carried out on both the rotor disks and the stator disks (or the counter-rotating disks) as the case may be.

BRIEF DESCRIPTION OF THE DRAWINGS

A further description of the present invention will be made in conjunction with the attached sheet of drawings in which:

FIG. 1 is a fragmentary view in cross section of a multiple disk refiner assembly embodying the principles of the present invention;

FIG. 2 is a fragmentary cross-sectional view taken substantially along the line II—II of FIG. 1;

FIG. 3 is a detailed view illustrating the physical relationships between the disks and the supporting membranes;

FIG. 4 is a view similar to FIG. 3 but showing the increased capacity for flexing afforded by the present invention, the drawing being exaggerated for purposes of clarity;

FIG. 5 is a fragmentary view partially in elevation and partially in cross section of the support means used for supporting stationary refining disks according to the present invention; and FIG. 6 is a fragmentary cross-sectional view of a different form of groove.

DESCRIPTION OF THE PREFERRED EMBODIMENTS

In FIG. 1, reference numeral 10 indicates generally a multiple disk refiner of the type to which the present improvements apply. The refiner 10 includes a housing 11 in which a driven shaft 12 is mounted for rotation. The shaft 12 has a step-down hub portion 13 which is mechanically coupled to a rotor generally indicated at reference numeral 14. The rotor 14 has a hub 15 which is confined against axial movement by means of a shoulder 12*a* on the driven shaft 12 and a thrust plate 16 and a spacer 17. A bolt 18 passes through the spacer 17 and is threaded into the hub portion 13. Bolts 19 press the thrust plate 16 against the spacer 17.

A stud 20 has an end portion 20*a* threaded into the rotor hub 15 and carries a plurality of spacer rings 21 and 22 which serve to locate the inner radial portions of the flexible membranes, as will be apparent from a succeeding portion of this description. A threaded portion 20*b* on the opposite end is provided with a nut 23 to urge the spacer rings 21 and 22 together and thereby clamp the ends of the flexible membranes.

The rotor assembly 14 in the form of the invention shown in FIG. 1 includes individual rotor elements 24, 25 and 26. The innermost ends of the rotor elements 24 are apertured so as to be received about the stud 20 and clamped in spaced relation between the spacer rings 21 and 22 and the hub 15, respectively.

As best illustrated in FIG. 2, each of the membranes 24, 25 and 26 has arcuate slots such as slots 27 which permit the flow of the suspension between the rotor elements for passage between the refining disks.

The flexible membrane 24 is clamped, or adhesively secured between a pair of rotary refiner disks 30 and 31. Similarly, the membrane 25 is secured between a pair of rotary refiner disks 32 and 33 while the membrane 26 is secured between a pair of rotary refiner disks 34 and 35. Each of the faces of the rotary refiner disks is provided with refining surfaces such as angularly extending ribs 36 shown specifically in FIG. 2.

The rotary refiner disk 30 is in confronting relation with an end plate 37 which is secured to the housing 11 by means of a screw 38. The confronting face of the end plate 37 also has angularly extending ribs which serve to abrade the suspended fibers and fibrillate the same into a uniform suspension. A small gap 39 exists between the confronting faces of the end plate 37 and the rotary refiner disk 30 through which the suspension passes and is acted upon by the confronting ribs.

The pairs of rotor disks shown in FIG. 1 are arranged to cooperate with pairs of stator disks such as disks 41 and 42 which also have ribs which confront the opposed ribs on the rotor disks 31 and 32, respectively. The spacing between the stator and rotor disk combinations is represented by gaps 43 and 44 which define the working gaps through which the suspension of fibers is passed in flowing from the inlet and ultimately through a discharge outlet 45. The stator disks 41 and 42 are supported from a flexible membrane 46 which may also be composed of a fiberglass composite, a flexible metal, or other suitable material. The disks are held together by screws 47. The membranes 46 are secured to the housing 11 through the use of studs 48 and spacers 49 which clamp the outer marginal edges of the membranes 46 to the housing 11.

In similar manner, stator disks 51 and 52 are secured together by means of a screw 53 and are supported from a flexible membrane 54. The dual stator disks provide working gaps 55 and 56 between their outer surfaces and the confronting outer surfaces of the rotor disks 33 and 34, respectively. Finally, rotor disk 35 confronts an end plate 57 and is spaced therefrom by means of a gap 58 to provide a working gap between the plate 57 and the outermost rotor disk 35.

An alternate form of support for the stator disks is illustrated in FIG. 5 of the drawings. Instead of using annular membranes such as the membranes 46 and 54 shown in FIG. 1, the disks may be supported by means of flexible fingers 59 which are secured to the housing 11 by means of screws 60.

In keeping with the present invention, the axial flexibility of both sets of refiner disks is improved by providing undercuts in the disks as best illustrated in FIGS. 3 and 4.

The axial flexibility of the membranes is a function of the material constants and the geometry. The various geometric parameters have been illustrated in FIG. 3. Dimension A represents the radial depth of the undercut and reference character B represents the maximum axial dimension of a rotor disk. Reference character C represents the unsupported radial annular dimension of the refiner disk while reference character D represents the width of the undercut. For best refining characteristics, the annular extent of the disk should be as large as possible. The unsupported annular dimension C should, however, be as large as possible since it renders the membrane more flexible. Consequently, a compromise is made between these two requirements. By providing an undercut in the disk as shown in FIG. 3, the actual refining surface as defined by the face of the disk can be maintained while the unsupported annular dimension C is increased, thereby providing greater flexibility. The width or axial depth of the undercut represented by letter D must be large enough to permit the desired movement of the membrane, but must be small enough so that the unsupported, undercut radially inner edge of the refining disk can withstand refining loads. Specifically, it is desirable that the radial extent of the undercut represented by reference character A be at least 10% of the unsupported radial annular dimension of the refiner disks, represented by reference character C. Also, the axial depth of the undercut portion represented by dimension D should be at least one-half of the maximum axial dimension of the disks represented by reference character B. In this compromise, the disks are undercut as far as possible to increase the flexibility but the undercut still remains small enough such that refining loads do not deflect the cantilever section beyond an acceptable refining limit.

The manner in which the membrane is deflected is shown in FIG. 4 in an exaggerated form. As illustrated, the membrane 25 commences bending in an area 25*a* which is within the confines of the undercut rather than between the disks and the rotor support.

The undercuts may also be applied to the stator structures as shown, for example, by an annular relief groove 61 in FIG. 5.

The specific configuration shown for the undercut in the drawings is that of a rectangular cross section and this represents the preferred form, but it should be recognized that various other geometric shapes can be used as desired. For example, an undercut triangularly shaped in cross section would permit the desired movement of the membrane while maintaining more mass and strength in the unsupported portion of the disk. This would allow a deeper undercut and may be less likely to become clogged by the material being refined than the rectangularly shaped undercut. The undercuts also may be filled with a low bulk modulus material to prevent stock from filling the undercut volume. The material in the undercut should compress or otherwise yield to the bending membrane.

FIG. 6 illustrates such a configuration by providing refiner disks 63 and 64 with a triangular groove 65 into which a flexible membrane 66 extends.

The present invention thus provides for improved axial flexibility of the supports in a multi-disk refiner whereby a minimal force gradient across the disk pairs is achieved, thus improving the uniformity of the refining.

It should be evident that various modifications can be made to the described embodiments without departing from the scope of the present invention.

We claim as our invention:

1. In an apparatus for refining fibrous materials including a housing, an inlet into said housing for receiving fibrous materials to be treated, an outlet from said housing for discharging treated materials, a shaft rotatable in said housing, a first plurality of refiner disks spaced along said shaft for rotation therewith, an additional plurality of refiner disks interleaved with said first plurality of disks and providing with the rotating disks pairs of refiner disks which rotate relative to each other and provide a refining gap therebetween, the confronting faces of the disks presenting confronting ribs to the fibrous materials passing through said refining gaps, and axially flexible annular membranes supporting both pluralities of disks in spaced relation, the improvement which comprises:

said refiner disks having undercut portions in the surfaces in which said flexible annular membranes are drivingly connected to permit bowing of said membranes within said undercut portions and thereby increase the axial flexibility of said membranes.

2. An apparatus according to claim 1 in which:

said flexible annular membranes consist of fiberglass composites.

3. An apparatus according to claim 1 wherein said undercut portions have a radial extent of at least 10% of the unsupported radial annular dimension of said refiner disks.

4. An apparatus according to claim 1 wherein the axial depth of said undercut portions is between about 10% and 50% of the maximum axial dimension of the disks.

5. An apparatus according to claim 1 in which said additional plurality of disks is stationary.

6. An apparatus according to claim 5 which includes:

fingers secured to said housing to which said additional plurality of disks is secured.

7. An apparatus according to claim 1 wherein said undercut portions are rectangular in cross section.

8. An apparatus according to claim 1 wherein said undercut portions are triangular in configuration.

* * * * *